US006031414A

United States Patent [19]

Kitamura

[11] Patent Number: 6,031,414

[45] Date of Patent: Feb. 29, 2000

[54] CONSTANT CURRENT CIRCUIT WITH SMALL OUTPUT CURRENT FLUCTUATION

[75] Inventor: Masahiro Kitamura, Kanagawa, Japan

[73] Assignee: NEC Corporation, Japan

[21] Appl. No.: 09/106,595

[22] Filed: Jun. 29, 1998

[30] Foreign Application Priority Data

Jun. 30, 1997 [JP] Japan ..... 9-187160

[51] Int. Cl.[7] ..... G05F 1/10

[52] U.S. Cl. ..... 327/538; 327/542; 327/543; 323/312; 323/315

[58] Field of Search ..... 327/538, 542, 327/543; 323/311, 312, 313, 315, 316

[56] References Cited

U.S. PATENT DOCUMENTS

| | | | |
|---|---|---|---|
| 5,304,862 | 4/1994 | Memida | 327/538 |
| 5,381,083 | 1/1995 | Inamori et al. | 323/313 |
| 5,654,665 | 8/1997 | Menon et al. | 327/541 |
| 5,760,639 | 6/1998 | Hall | 327/539 |

FOREIGN PATENT DOCUMENTS

| | | |
|---|---|---|
| 135616 | 2/1989 | Japan . |
| 290214 | 3/1990 | Japan . |
| 59218014 | 12/1994 | Japan . |

*Primary Examiner*—Kenneth B. Wells
*Assistant Examiner*—Hai L. Nguyen
*Attorney, Agent, or Firm*—Ostrolenk, Faber, Gerb & Soffen, LLP

[57] ABSTRACT

A constant current circuit whose output current is less dependent on a current gain of a transistor or an Early voltage thereof is provided. The constant current circuit includes a differential circuit between transistors forming a constant current generating unit and a current mirror circuit. This differential circuit operates as a feedback circuit and the mirror coefficient of the current mirror circuit becomes hardly affected by the current gain or the Early voltage.

4 Claims, 5 Drawing Sheets

CONSTANT CURRENT CIRCUIT WITH SMALL OUTPUT CURRENT FLUCTUATION

BACKGROUND OF THE INVENTION

1. Field of the Invention

The present invention relates to a constant current circuit, and more specifically, to a constant current circuit wherein currents in equal magnitude flow in collectors (drains) of two transistors with different emitter (source) sizes and a constant current based on a voltage difference generated between bases (gates) and emitters (sources) of the transistors is output thereby.

2. Description of the Related Art

An example of a conventional constant current circuit of the above kind is shown in FIG. 1.

In the constant current circuit shown in FIG. 1, a current mirror circuit consisting of PNP transistors Q23 and Q24 is connected to the output: of a constant current generating unit consisting of resistor 21 and NPN transistors Q21 and Q22 whose emitter size ratio is 1:n1, and output current Iout is obtained by transistors Q23 and Q24 and PNP transistor Q25 which shares the common base with the transistors Q23 and Q24.

In this circuit, let Iref be a reference current flowing in the emitter of transistor Q22, I1 be a current flowing in the emitter of transistor Q21, and Iout be an output current flowing in the collector of transistor Q25. Let 1:n1 be the emitter size ratio of transistors Q21 and Q22, 1:n2 be the emitter size ratio of transistors Q24 and Q25, and R21 be a resistor connected to transistor Q22 in series. Regarding the effect of a current gain hFE of the PNP transistors, the following equations are obtained:

$$\mathrm{Iref}=(1/\mathrm{R}\mathbf{21})\cdot(\mathrm{K}\cdot\mathrm{T}/q)\cdot 1n(n1\cdot\mathrm{I1}/\mathrm{Iref})$$

$$\mathrm{I1}=\mathrm{Iref}\cdot\mathrm{hFE}/(\mathrm{hFE}+2+n2)$$

$$\mathrm{Iout}=\mathrm{Iref}\cdot n2\cdot\mathrm{hFE}/(\mathrm{hFE}+2+n2)$$

where K means the Boltzmann constant, T the absolute temperature, and q a charge of electrons.

As is obvious from the above equation, output current Iout is greatly dependent on the current gain. Output current Iout is also dependent on Early voltage $V_A$, as shown below:

$$\mathrm{I1}=\mathrm{Iref}\cdot(1+V_{CE}\mathbf{Q23}/V_A)/(1+V_{CE}\mathbf{Q24}/V_A)$$

$$=\mathrm{Iref}\cdot(1+V_{CE}\mathbf{Q23}/V_A)/(1+V_{BE}\mathbf{Q24}/V_A)$$

$$\mathrm{Iout}=\mathrm{Iref}\cdot n2(1+V_{CE}\mathbf{Q25}/V_A)/(1+V_{BE}\mathbf{24}/V_A)$$

FIGS. 3 and 4 are diagrams showing dependency characteristics of output current Iout on hFE and on Early voltage respectively, both of which have been obtained by simulation. Dashed lines 20 in FIGS. 3 and 4 show output characteristics of this circuit.

FIG. 2 shows a configuration of another conventional constant current circuit of this kind with improved hFE dependency of the output current and comprising transconductance amplifier (TCA) circuit 6.

In the circuit configuration shown in FIG. 2, transistors Q40 and Q41 are connected sharing the common base with transistors Q31 and Q32. The emitter sizes of transistors Q31 and Q40 are the same, and so are for Q32 and Q41. Resistors R31 and R32 have the same resistance.

The collector of transistor Q40 is connected to the inverting input terminal of a differential circuit constituting TCA circuit 6. The collector of transistor Q11 is connected to the non-inverting input terminal of the differential circuit. The output of this differential circuit is connected to the collector of transistor Q32.

Operation of the conventional circuit shown in FIG. 2 will be explained below.

Collector current IC10 of transistor Q40 and collector current IC11 of transistor Q41 generate a differential current in the same magnitude as a current difference between collector current IC1 of transistor Q31 and collector current IC2 of transistor Q32. The differential current is converted into differential voltage Δ Vd by resistors R33 and R34. The differential voltage is then converted into a current by the differential circuit constituting TCA circuit 6, and supplied to the collector connection point between transistors Q32 and Q34.

For example, if the current gain hFE of the PNP transistors decreases, the current gain of transistors Q33, Q34 and Q39 becomes smaller, and the base current of transistors Q33, Q34 and Q39 becomes larger. As a result, a current difference (IC2–IC1) becomes larger and so does a differential current (IC11–IC10). Therefore, TCA input voltage ΔVd becomes larger, and a TCA output current (IC6–IC7=$I_F$8) becomes larger and is fed back to reduce the current difference (IC2–IC1).

With such feedback control, a change in output current Iout is made to be small even in the case where the current gain hFE decreases.

As described above, among the above conventional constant current circuits, the circuit shown in FIG. 1 has the problem that the output current depends on both the current gain hFE and the Early voltage. On the other hand, the circuit shown in FIG. 2 has the problem that the output current depends on the Early voltage, although the effect of current gain fluctuation can be made small. In other words, in the case of low Early voltage, collector-emitter voltages $V_{CE}$ of transistors Q32, Q33, Q40, and Q41 become high when a power source voltage becomes high. This leads to increases in currents IC1, IC2, IC10, and IC11. However, since transistors Q32 and Q33 are of different conductivity type and thus have different Early voltages, currents IC1 and IC2 have increases in different magnitude.

Furthermore, the collector-emitter voltages $V_{CE}$ of transistors Q31 and Q40 are not the same, and accurate current difference and voltage difference are hard to obtain. As a consequence, output current Iout becomes fluctuant in response to a variance in the Early voltage or a fluctuation of the power source voltage.

SUMMARY OF THE INVENTION

It is an object of the present invention to provide a constant current circuit which is not dependent on the current gain hFE or the Early voltage.

In the present invention, by forming a feedback circuit comprising a differential circuit between transistors of a conventional constant current circuit, a variance or a fluctuation of output current due to the current gain hFE or the Early voltage is reduced.

Furthermore, dependency of the output current on the current gain hFE or the Early voltage is also reduced by using not only bipolar transistors but also MOSFETs.

The above and other objects, features and advantages of the present invention will become apparent from the following description with reference to the accompanying drawings which illustrate examples of the present invention.

DESCRIPTION OF THE PREFERRED EMBODIMENTS OF THE INVENTION

Figure 5:
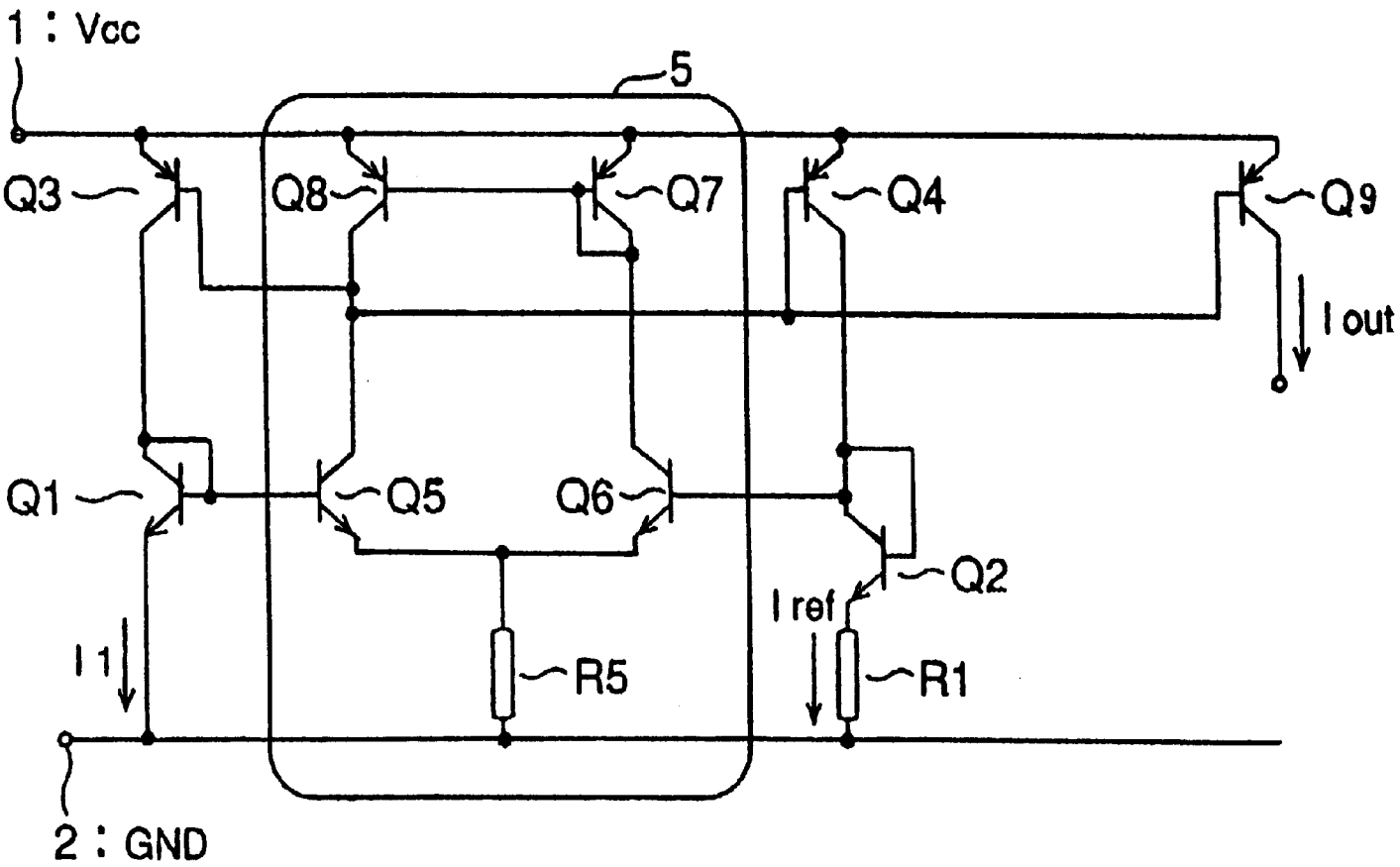
FIG. 5 is a circuit diagram showing a constant current circuit according to a first embodiment of the present invention.

Referring now to FIG. 5, a constant current circuit according to a first embodiment of the present invention comprises differential circuit 5 composed of transistors Q5, Q6, Q7 and Q8 and resistor R5. The collector and the base of transistor Q1 are commonly connected to the inverting input terminal of differential circuit 5, the collector and the base of transistor Q2 are commonly connected to the non-inverting input terminal thereof, and resistor R1 is connected in series to the emitter of transistor Q2. The bases of transistors Q3 and Q4 which have their conductivity opposite from that of transistor Q1, Q2 are connected to the inverting output terminal of differential circuit 5.

To the constant current output terminal of differential circuit 5, transistor Q9 which shares a base with transistors Q3 and Q4 is connected, and a constant current is output from the collector of transistor Q9.

Operation of the constant current circuit in this embodiment will be explained below.

Figure 4:
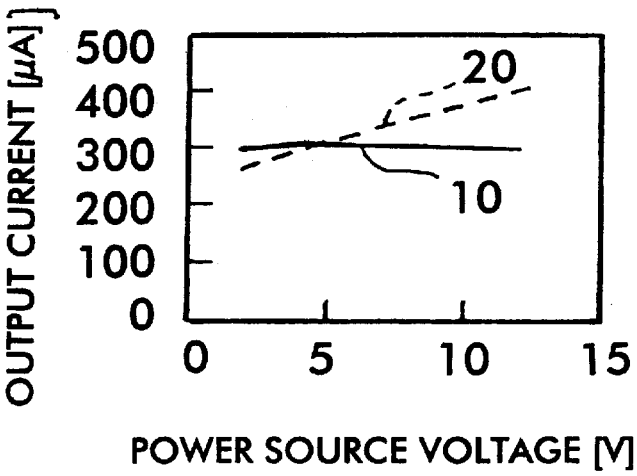
FIG. 4 is a diagram obtained by simulation and showing Early voltage dependency of the output current.

In FIG. 4, Iref denotes a reference current flowing in the emitter of transistor Q2, I1 a current in the emitter of transistor Q1, and Iout a current in the collector of transistor Q5. Let 1:n1 be the emitter size ratio of transistors Q1 and Q2, and 1:n2 for transistors Q4 and Q5. R1 is a resistor connected in series to transistor Q2. The following equations show the relation between them:

$$\mathrm{Iref}=(1/\mathrm{R1})\cdot(\mathrm{K}\cdot\mathrm{T}/q)\cdot 1n(n1\cdot \mathrm{I1}/\mathrm{Iref})$$

$$(\mathrm{K}\cdot\mathrm{T}/q)\cdot 1n\{(1+\mathrm{hFE})/\mathrm{hFE}\cdot\mathrm{Iref}/\mathrm{Is}\}$$

$$=(\mathrm{K}\cdot\mathrm{T}/q)\cdot 1n\{(1+\mathrm{hFE})/\mathrm{hFE}\cdot\mathrm{I1}/\mathrm{Is}\}$$

$$=(\mathrm{K}\cdot\mathrm{T}/q)\cdot 1n\{(1+\mathrm{hFE})/\mathrm{hFE}\cdot\mathrm{Iout}/n2\cdot\mathrm{Is}\}$$

where K is the Boltzmann constant, T the absolute temperature, q a charge of an electron, and Is a saturation current. From the above equations, equations $$\mathrm{I1}=\mathrm{Iref},\ \text{and}\ \mathrm{Iout}=n2\cdot\mathrm{Iref}$$

are obtained, which means output current Iout is not affected by hFE.

For an Early voltage $V_A$, the following equations are obtained:

$$\mathrm{I1}=\mathrm{Iref}\cdot(1+V_{CE}\mathrm{Q3}/V_A)/(1+V_{CE}\mathrm{Q4}/V_A)$$

$$\mathrm{Iout}=\mathrm{Iref}\cdot n2\cdot\{(1+V_{CE}\mathrm{Q5}/V_A)/(1+V_{CE}\mathrm{Q4}/V_A)\}.$$

However, the collector voltage of transistor Q4 is equal to that of transistor Q3 due to a feedback circuit comprising transistors Q4, Q5, and Q6. Therefore, $V_{CE}$ Q3=$V_{CE}$ Q4, and I1=Iref. As a result, current I1 is not affected by the Early voltage $V_A$.

Furthermore, output current Iout is less influenced by the Early voltage $V_A$ than a conventional constant current circuit, since $V_{CE}\mathrm{Q4}\neq V_{BE}$.

Figure 3:
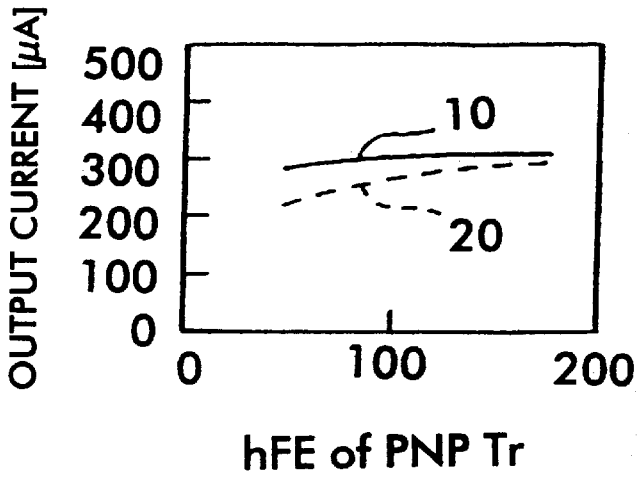
FIG. 3 is a diagram obtained by simulation and showing hFE dependency of an output current.

FIGS. 3 and 4 show dependency characteristics of the output current on the iFE and on the Early voltage respectively. Both diagrams were obtained by simulation. Solid lines 10 in both diagrams show characteristics of the circuit according to this embodiment.

Figure 1:
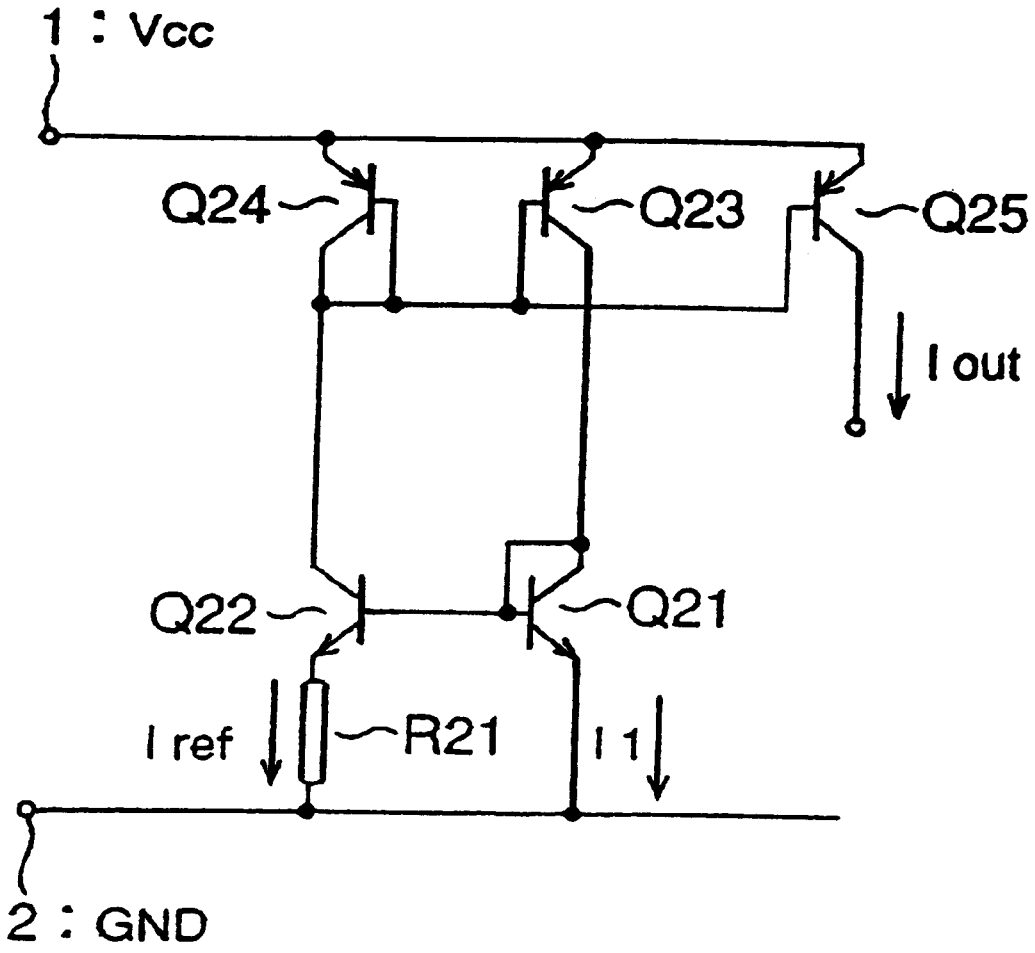
FIG. 1 PRIOR ART
FIG. 1 is a circuit diagram of a conventional constant current circuit.
Figure 2:
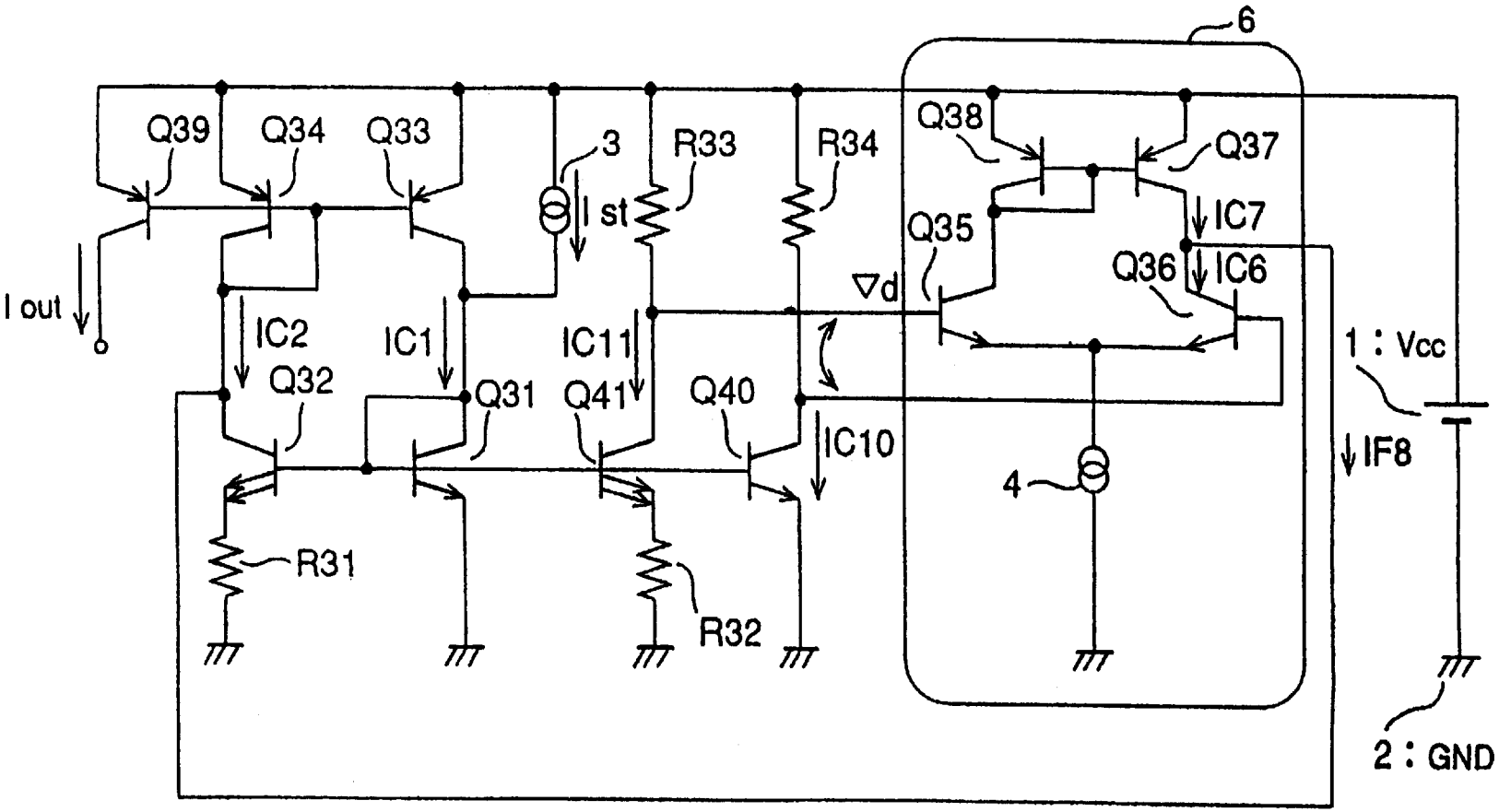
FIG. 2 PRIOR ART
FIG. 2 is a circuit diagram of another conventional constant current circuit.

As is obvious from comparison between solid lines 10 and dashed lines 20 showing the output characteristics of the conventional circuit shown in FIG. 1, the mirror coefficient in this embodiment is hardly affected by the current gain hFE, since the bases of transistors Q3, Q4 and Q5 are commonly connected without a short circuit between the collector and the base of transistor Q4. Furthermore, by supplying feedback of the collector-base voltage of transistor Q4 and that of transistor Q3 in order to equalize the inverting input voltage of differential circuit 5 and the non-inverting input voltage thereof, the mirror coefficient of transistors Q3 and Q4 is hardly affected by the Early voltage. Therefore, preferable characteristics shown by solid lines 10 in FIGS. 3 and 4 are obtained.

In the embodiment shown in FIG. 5, the constant current output terminal is connected to only one transistor Q5 which shares a base with transistors Q3 and Q4. However, a plurality of transistors may be connected to the constant current output terminal.

Figure 6:
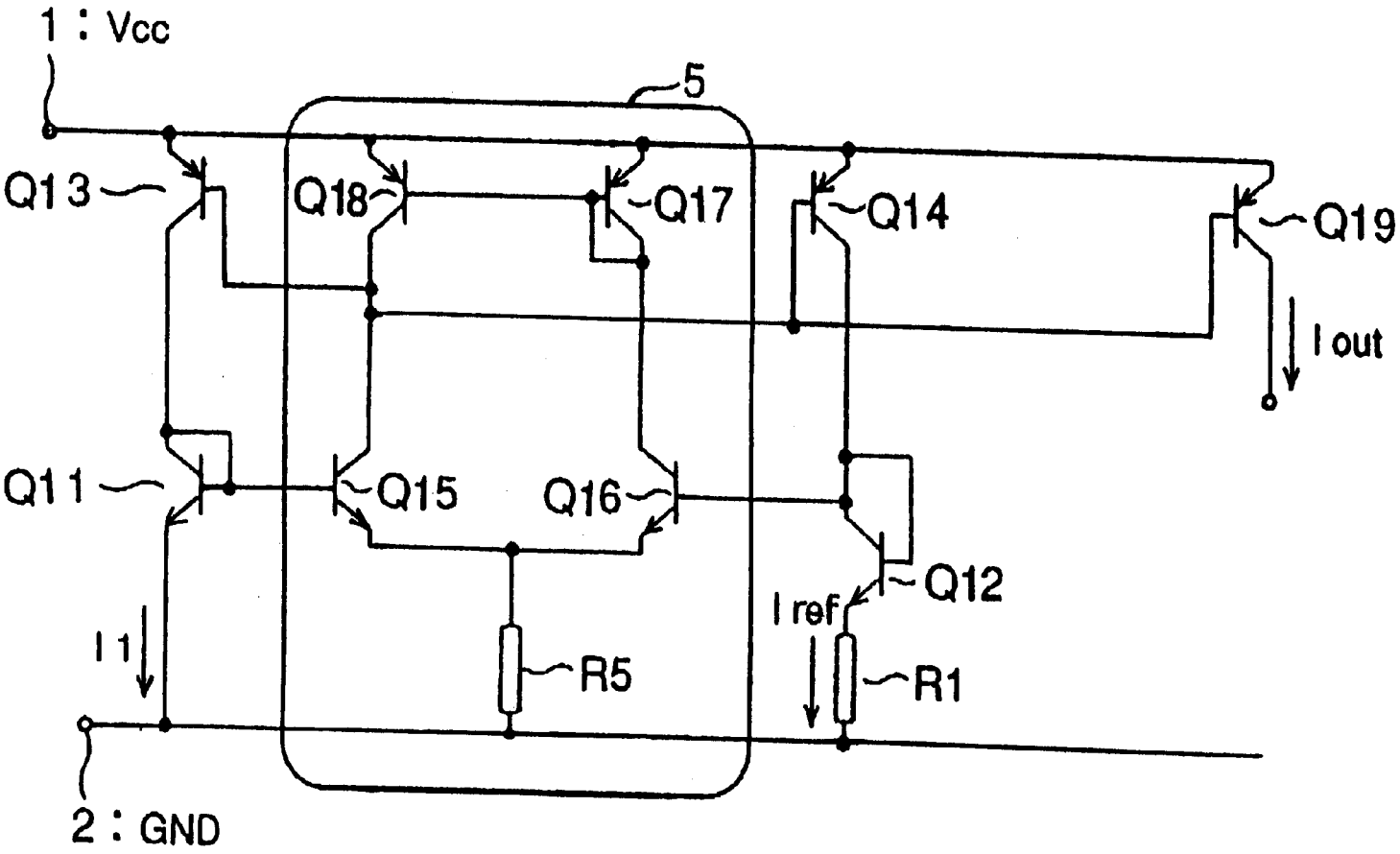
FIG. 6 a circuit diagram showing a constant current circuit according to a second embodiment of the present invention.

As shown in FIG. 6, in a second embodiment of the present invention, P type Metal Oxide Semiconductor (MOS) Field Effect Transistors (FET) Q11, Q12, Q15 and Q16 replace transistors Q1, Q2, Q5 and Q6 of the constant current circuit in the first embodiment shown in FIG. 5, and N type MOSFET Q13, Q14, Q17 and Q18 replace transistors Q3, Q4, Q7 and Q8. Operation of the second embodiment is the same as that of the first embodiment.

While preferred embodiments of the present invention have been described using specific terms, such description is for illustrative purposes only, and it is to be understood that changes and variations maybe made without departing from the spirit or the scope of the following claims.

What is claimed is:

1. A constant current circuit which outputs a constant current based on a voltage difference generated between the bases and emitters of transistors with different emitter sizes by currents in equal magnitude flowing in the collectors thereof; the constant current circuit comprising:

a differential circuit operating on a common power source;

a first bipolar transistor of a first conductivity type whose collector and base are commonly connected to the inverting input termlnal of the differential circuit and whose emiitter is commonly grounded;

a second bipolar transistor of the first conductivity type whose collector and base are connected to the non-inverting input terminal of the differential circuit and whose emitter is commonly grounded via a resistor;

a third bipoIar transistor of a second conductivity type which is opposite from the first conductivity type, with the emitter thereof being connected to the common power source, the collector thereof being connected to the collector of the first bipolar transistor, and the base thereof being connected to the inverting output terminal of the differential circuit;

a fourth bipolar transistor of the second conductivity type whose emitter is connected to the common power source, whose collector is connected to the collector of the second bipolar transistor, and whose base is connected to the inverting output terminal of the differential circuit; and at least one fifth bipolar transistor of the second conductivity type whose emitter is connected to the common power source and whose base is commonly connected to the third and fourth bipolar transistors, wherein the constant current is output from the collector of the fifth bipolar transistor.

2. A constant current circuit as claimed in claim 1, which is formed in a semiconductor integrated circuit.

3. A constant current circuit which outputs a constant current based on a voltage difference generated between the sources and drains of transistors with different source sizes by currents in equal magnitude flowing in the drains thereof; the constant current circuit comprising:

a differential circuit operating on a common power source;

a first MOSFET of a first conductivity type whose drain and gate are commonly connected to the inverting input terminal of the differential circuit and whose source is commonly grounded;

a second MOSFET of the first conductivity type whose drain and gate are commonly connected to the inverting input terminal of the differential circuit and whose source is commonly grounded via a resistor;

a third MOSFEIT of a second conductivity type which is opposite from the first conductivity type, with the source thereof being connected to the common power source, the drain thereof being connected to the drain of the first MOSFET, and the gate thereof being connected to the inverting output terminal of the differential circuit;

a fourth MOSFET of the second conductivity type whose source is connected to the common power source, whose drain is connected to the drain of the second MOSFET, and whose gate is connected to the inverting output terminal of the differential circuit; and at least one fifth MOSFET of the second conductivity type whose source is connected to the common power source and whose gate is commonly connected to the third and fourth MOSFETs, wherein the constant current is output from the drain of the fifth MOSFET.

4. A constant current circuit as claimed in claim 3, which is formed in a circuit of a semiconductor integrated circuit.

* * * * *